US008260608B2

(12) United States Patent
Opitz et al.

(10) Patent No.: US 8,260,608 B2
(45) Date of Patent: Sep. 4, 2012

(54) DROPOUT CONCEALMENT FOR A MULTI-CHANNEL ARRANGEMENT

(75) Inventors: Martin Opitz, Vienna (AT); Cornelia Falch, Rum (AT); Robert Höldrich, Graz (AT)

(73) Assignee: AKG Acoustics GmbH, Vienna (AT)

( * ) Notice: Subject to any disclaimer, the term of this patent is extended or adjusted under 35 U.S.C. 154(b) by 706 days.

(21) Appl. No.: 12/479,046

(22) Filed: Jun. 5, 2009

(65) Prior Publication Data

US 2009/0306972 A1 Dec. 10, 2009

(30) Foreign Application Priority Data

Dec. 7, 2006 (WO) ..... PCT/EP2006/011759

(51) Int. Cl.
*G10L 19/02* (2006.01)

(52) U.S. Cl. ..... 704/205; 704/219

(58) Field of Classification Search ..... 704/205, 704/219

See application file for complete search history.

(56) References Cited

U.S. PATENT DOCUMENTS

| | | | | |
|---|---|---|---|---|
| 5,793,801 | A * | 8/1998 | Fertner | 375/219 |
| 6,658,378 | B1 * | 12/2003 | Maeda | 704/200.1 |
| 6,904,110 | B2 * | 6/2005 | Trans et al. | 375/350 |
| 7,139,701 | B2 * | 11/2006 | Harton et al. | 704/217 |
| 7,155,388 | B2 * | 12/2006 | Kushner et al. | 704/233 |
| 7,254,535 | B2 * | 8/2007 | Kushner et al. | 704/226 |

* cited by examiner

*Primary Examiner* — Susan McFadden

(74) *Attorney, Agent, or Firm* — Brinks Hofer Gilson & Lione

(57) ABSTRACT

A method conceals dropouts in one or more audio channels of a multi-channel arrangement. The method maps transmitted signals into a frequency domain during an error-free signal transmission of two or more channels. A magnitude spectra and spectral filter coefficients are derived. The spectral filter coefficients relate the magnitude spectrum of the audio channel to the magnitude spectrum of at least one other channel. When a dropout occurs, a replacement signal is generated through the filter coefficients and a substitution signal. The filter coefficients may be generated prior to the detection of the dropout.

37 Claims, 5 Drawing Sheets

DROPOUT CONCEALMENT FOR A MULTI-CHANNEL ARRANGEMENT

PRIORITY CLAIM

This application claims the benefit of priority from International Application No. PCT/EP2006/011759, filed Dec. 7, 2006, which is incorporated by reference.

BACKGROUND OF THE INVENTION

1. Technical Field

This disclosure relates to a system that conceals dropouts in one or more channels of a multi-channel arrangement. A replacement signal is generated in the event of a dropout with the aid of at least one error-free channel.

2. Related Art

The wireless transmission of audio signals is used in stage performances, concerts and live shows. In comparison to analog systems, digital transmissions may combine channels, exploit interoperability, and transmit metadata and audio data. The metadata may contain information about a stage installation.

The wireless transmission of signals may not be resistant to influences that may affect a transmission link. Disturbances may directly lead to digital losses and total signal dropouts. The degradation of the signal quality may require compensation that may introduce perceptible delays.

SUMMARY

A method conceals dropouts in one or more audio channels of a multi-channel arrangement. The method maps transmitted signals into a frequency domain during an error-free signal transmission of two or more channels. A magnitude spectra and spectral filter coefficients are derived. The spectral filter coefficients relate the magnitude spectrum of the audio channel to the magnitude spectrum of at least one other channel. When a dropout occurs, a replacement signal is generated through the filter coefficients and a substitution signal. The filter coefficients may be generated prior to the detection of the dropout.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

In the following, the invention is described in more detail on the basis of the drawings.

DETAILED DESCRIPTION OF THE PREFERRED EMBODIMENTS

Figure 1:
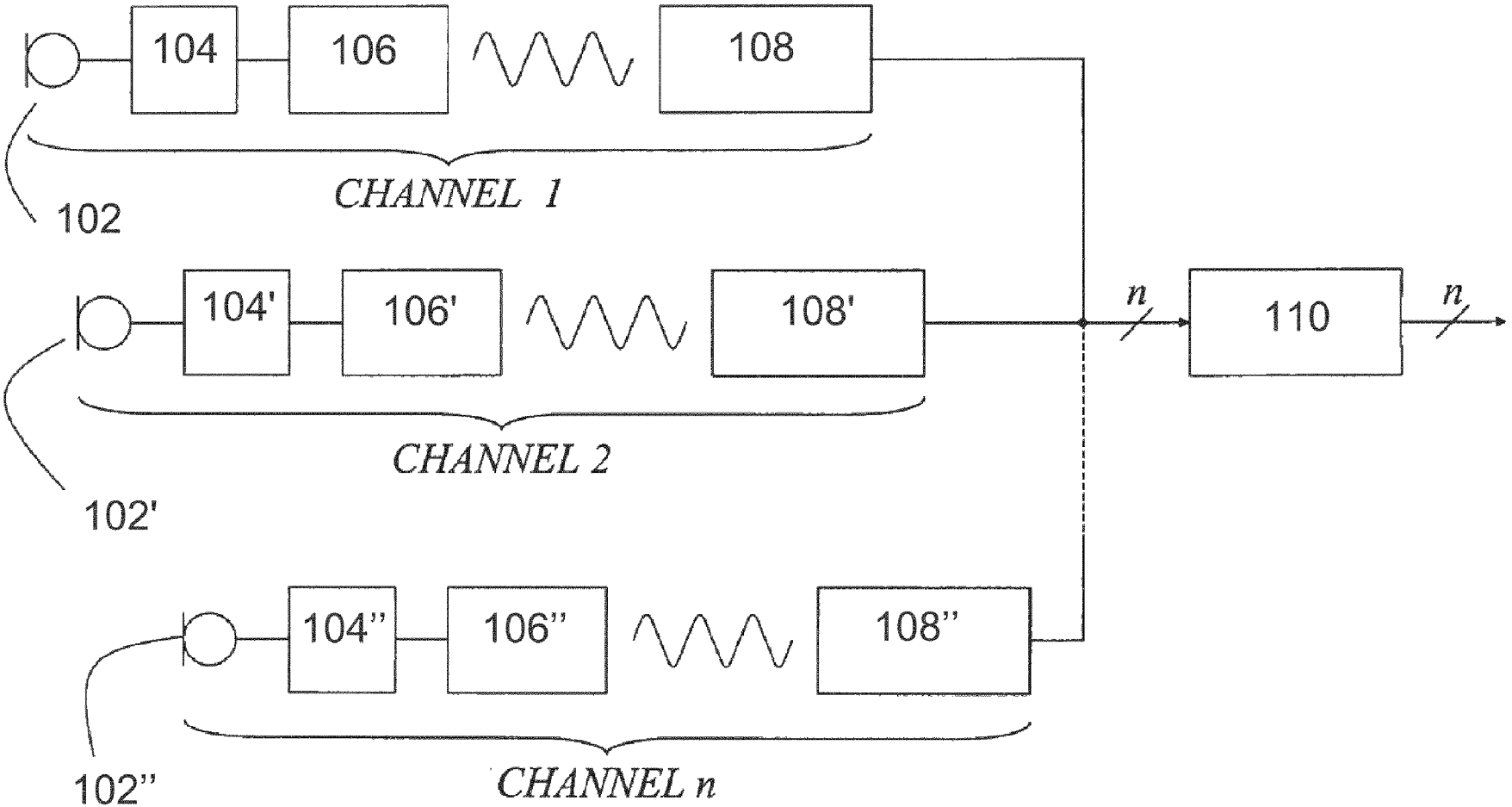
FIG. 1 is a representation of the transmission chain.

A receiver-based method is decoupled from a transmitter or source coding. The method is not affected by the latency inherent to transmitter-controlled technologies. Some receiver-based concealment methods are represented by intra-channel concealment techniques. In these techniques, each channel of a multi-channel arrangement is treated separately. Some concealment methods may apply substitution and prediction algorithms. The latter may be comprised by two stages, the analysis unit and the re-synthesis model of the linear prediction error filter. The first stage may estimate the filter coefficients and is executed continuously during error-free signal transmission.

If a dropout occurs, the lost signal samples are reconstructed by a filtering process. This may correspond to an extrapolation suited to the concealment of dropouts of about a few milliseconds in general broadband audio signals. In some applications, in which the real-time constraint is not as stringent (for example, the buffering of data is permissible), the extrapolation may be transformed into an interpolation and longer dropouts can therefore be handled.

The expansion of one-channel systems to multi-channel systems in an inter-channel concealment technique, may be implemented through adaptive filters. Compared to linear prediction algorithms, the estimation of the filter coefficients may not be exclusively to the signal of the respective channel, but rather information from other parallel channels is also used.

The exploitation of the channel cross correlations may improve the performance of a concealment process. One possible implementation of this method is described in US 200510182996 A1 (and respective EP 1649452 A1), which is incorporated by reference.

A feature of the abovementioned filter techniques denotes the processing in time domain; some algorithms also offer an equivalent process in frequency domain. The transformation increases computing efficiency, while the characteristics of the time domain method are retained.

Some concealment methods may use the intact channels of a multi-channel system to replace the lost signal. In some methods the difference between the original signal and its replacement may be rendered inaudible. These methods may improve the reliability of the transmission and the usability in delay-critical real-time systems.

During an error-free signal transmission of the channels a controller map the transmitted signals into the frequency domain. The controller or one or more subordinate controllers may derive the absolute value of the frequency spectrum and derive spectral filter coefficients that relate the magnitude spectrum of a channel to the magnitude spectrum of at least one other channel. In the event of the dropout of one channel the controller or subordinate controller may generate the replacement signal through the filter coefficients prior to the dropout. The filter coefficients may be further processed to derive a substitution signal which comprises an error-free channel.

The concealment filter may be established through a magnitude spectra without regard to phase data. By generating a more stable filter, the quality of the replacement signal may improve. The improvement may lie in the utilisation of the interoperability between individual signals.

A modified treatment of the phase data may also be processed. In these applications, the constancy of the phase transition at the beginning and at the end of the dropout may be improved by accounting for the average time delay between the target and replacement signal. A time delay between the respective channels, independent of their source direction, may emerge according to the spatial arrangement of the multi-channel recording system.

FIG. 1 is a multi-channel (optionally wireless) structure that transmits digital audio data. The system includes a signal source 102, a sensor that receives signals (microphone), an analog-digital converter 104 (ADC), an optional transmitted signal compression and coding a transmitter 106, a transmission channel, a receiver 108 for each channel in communication with a concealment module 110. At the output of the concealment module 110, the audio signal is available in digital form. In alternative systems ancillary devices may be coupled to the system including a pre-amp, equalizer, etc.

The concealment method may be independent of a transmitter/receiver. In some systems the source coding may act on the receiver side (receiver-based technique) exclusively. The system may be flexibly integrated into any transmission path as an independent module. In some transmission systems (e.g. digital audio streaming), different concealment strategies are implemented simultaneously.

The systems may have some exemplary applications:

a) In concert events and stage installations, multi-channel arrangements range from stereo recordings to different variations of surround recordings (e.g. OCT Surround, Decca Tree, Hamasaki Square, etc.) potentially supported by different forms of spot microphones. Especially with main microphone setups, the signals of the individual channels are comprised of similar components whose particular composition is often quite non-stationary. For example, a dropout in one main microphone channel can be concealed according to the present invention introducing little or no latency.

b) Multi-channel audio transmission in studios proceeds at different physical layers (e.g. optical fiber waveguides, AES-EBU, CATS), and dropouts may occur for various reasons, for example due to loss of synchronization, which may be prevented or concealed especially in critical applications such as, for example, in the transmission operations of a radio station. The concealment method may be used as a safety unit with a low processing latency.

c) While audio transmission in the internet may be less delay-sensitive than the abovementioned areas, transmission errors may occur more frequently, resulting in an increased degradation of the perceptual audio quality, The inventive concealment method may improve quality of service.

d) The method may be used in the framework of a spatially distributed, immersive musical performance, e.g., in the implementation of a collaborative concert of musicians that are separated spatially from each other. In this case, the ultra-low latency processing strategy of proposed algorithm benefits the system's overall delay.

The dropout concealment method is described for one channel affected with dropouts. In alternative systems it may be applied to multiple channels. In these systems a channel affected with dropouts is a target channel or signal. The replica (estimation) of this signal generated during dropout periods is the replacement signal. At least one substitution channel may be processed to compute the replacement signal.

A proposed algorithm may be comprised of two parts. Computations of the first part may occur permanently, a second part may be activated when a dropout occurs in the target channel. During error-free transmission, the coefficients of a linear-phase FIR (finite impulse response) filter of length $L_{FILTER}$ may be permanently estimated in the frequency domain. The information may be provided by the optionally non-linearly distorted and optionally time-averaged short-term magnitude spectra of the target and substitution channel. This filter computation may disregard any phase information and thus, differs from correlation-dependent adaptive filters.

Figure 2:
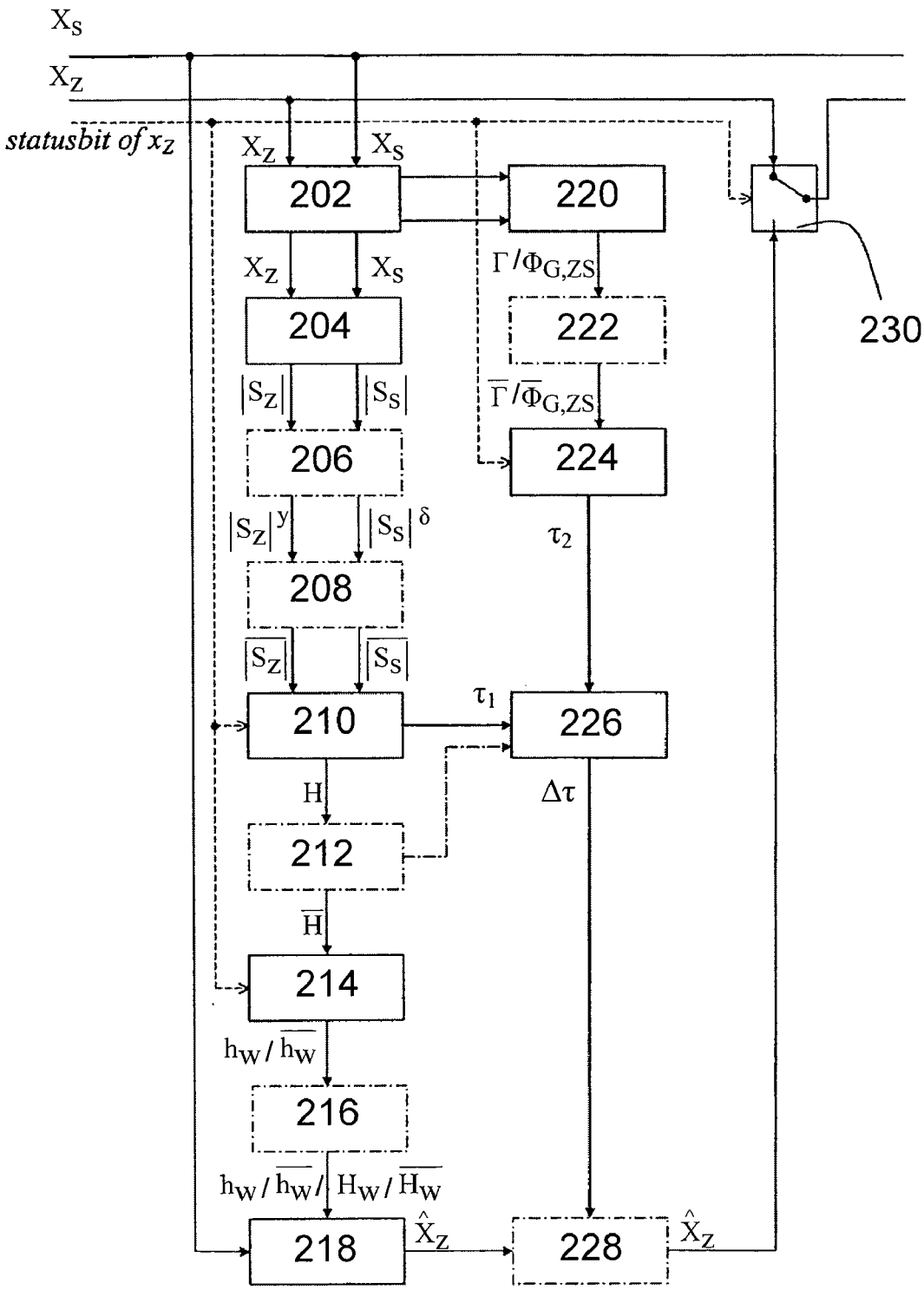
FIG. 2 is a block diagram of the dropout concealment of a two channel system.

FIG. 2 is a block diagram of the multi-channel dropout concealment method for a target signal $x_z$ and a substitution signal $x_s$. The individual acts of the method are each indicated by a box containing a reference symbol and denoted in the subsequent table:

202 Transformation into a spectral representation
204 Determination of the envelope of the magnitude spectra
206 Non-linear distortion (optional)
208 Time-averaging (optional)
210 Calculation of the filter coefficients
212 Time-averaging of the filter coefficients (optional)
214 Transformation into the time domain with windowing
216 Transformation into the frequency domain (optional)
218 Filtering of the substitution signal respectively in time or frequency domain
220 Estimation of the complex coherence function or GXPSD
222 Time-averaging (optional)
224 Estimation of the Gee and maximum detection in the time domain
226 Determination of the time delay $\Delta\tau$
228 Implementation of the time delay $\Delta\tau$ (optional)

In this example, the transition between target and replacement signal occurs by a switch 230. The selection of a substitution channel may depend on the similarity between the substitution and the target signal. This correlation may be determined by estimating the crosscorrelation or coherence. The (GXPSD) is a potential selection strategy. The complex coherence function $\Gamma_{zs,j}(k)$ may be used as particular example of about 1. to about 9. (A total of K channels are observed, the channel $x_o(n)$ being designated as the target channel $x_z(n)$.):

1. For the target channel $x_z(n)$, the $J^{th}$ channel may comprise a substitution signal by the optionally time-averaged coherence function $\overline{\Gamma_{ZS,j}(k)}$ between the channels $x_j(n)$, with $1 \leqq j \leqq K-1$ and the target channel $x_s(n)=x_j(n)$, whose frequency-averaged value of the complex coherence function, $$\chi(i) = \frac{1}{N}\sum_{k=0}^{N-1} |\overline{\Gamma_{ZS,j}(k)}|,$$

has a maximum value according to: J=arg m $\chi(j)$.

2. Alternatively, a fixed allocation may be established between the channels in advance if the user (e.g., a sound engineer) knows the characteristics of the individual channels (according to the selected recording method) and hence their joint signal information.
3. Several channels may be summed to one substitution channel, optionally in a weighted manner. This weighted combination may be set up by the user a priori.
4. In an alternative realization, the superposition of several channels to one substitution channel may be carried out on the basis of broadband coherence ratios to the target channel by:

$$x_s(n) = \frac{\sum_j \{\chi(j)\cdot x_j(n-\square\tau_j)\}}{\sum_j \chi(j)}, \text{ for all } \{\text{do } (j) = \text{false}\}.$$

Herein, $x_s(n)$ denotes the substitution channel comprised of the channels $x_j(n-\Delta\tau_j)$, and $\chi(i)$ represents the frequency-averaged coherence function between the target channel $x_z(n)$ and the corresponding channel $x_j(n-\Delta\tau_j)$. The time delay between the selected channel pairs is considered by $\Delta\tau_j$. The validity of the potential signals is verified incorporating the status bit do(j).

5. A simplification of 4. considers a pre-selected set of channels $\tilde{J}$ rather than all available channels i. The weighted sum is built using $\chi(j)|_{j\in\tilde{J}}$. The pre-selection is intended to yield channels whose frequency-averaged coherence function exceed a prescribed threshold $\Theta$:

$$\tilde{J}=\{j|(1\leqq j\leqq K-1)\wedge(\chi(j)>\Theta)\}.$$

6. Furthermore, a maximum number of M channels (with preferably M=2 . . . 5) may be established as a criterion, according to:

$$\tilde{J}=\{j_i|(1\leqq j_i\leqq K-1)\wedge(1\leqq i\leqq M)\wedge[\chi(j_i)>\chi(l),\ \forall l\in\{1,\ldots,K-1\}|\{j_1,\ldots,j_M\}]\}.$$

7. A joint implementation of constraints 5. and 6. is also possible:

$$\tilde{J}==\{j_i|(1\leqq j_i\leqq K-1)\wedge(1\leqq i\leqq M)\wedge(\chi(j_i)>\Theta)\wedge[\chi(j_i)>(l),\forall l\in\{1,\ldots,K-1\}|\{j_1,\ldots,j_M\}]\}.$$

8. Alternatively, the selection may be carried out separately for different frequency bands, e.g., in each band the "optimal" substitution channel is determined on the basis of the coherence function, the respective band pass signals are filtered using the described method to optionally in a time-delayed manner. It may be superposed and used as a replacement signal. In so doing, the same criteria apply as in 1., 4., 5., 6., and 7., though the frequency-independent function $|\overline{\Gamma_{ZS,j}(k)}|$ that is implemented instead of the frequency-averaged function $\chi(i)$.
9. Several substitution channels may be selected. In this case, the processing is carried out separately for each channel, e.g., several replacement signals are generated. These are weighted according to their coherence function, combined and inserted into the dropout.

The functions used in 1. to 9. are time-varying, thus a mathematical notations consider the time dependency by a (block) index m. To simplify the formulations, m is omitted.

The computation during error-free transmission may be performed in frequency domain. In a first step an appropriate short-term transformation is necessary, resulting in a block-oriented algorithm that requires a buffering of target and substitution signal. Preferably, the block size is aligned to the coding format. The estimation of the envelopes of the magnitude spectra of target and substitution signal are used to determine the magnitude response of the concealment filter. The exact narrow-band magnitude spectra of the two signals are not relevant, rather broad-band approximations are sufficient, optionally time-averaged and/or non-linearly distorted by a logarithmic or power function. The estimation of the spectral envelopes may be implemented in alternative systems. A short-term DFT with short block length, e.g., with a low spectral resolution may be used. A signal block is multiplied by a window function (e.g. Hanning), subjected to the DFT, the magnitude of the short-term DFT may be optionally distorted non-linearly and subsequently time-averaged.

Other alternative systems may include:

Wavelet transformation as described in Daubechies I.; "Ten Lectures-on Wavelets"; Society for Industrial and Applied Mathematics; Capital City Press, ISBN 0-89871-274-2, 1992, (the entire disclosure is incorporated by reference) which includes optional subsequent time-averaging of the optionally non-linear distortion of the absolute values of the wavelet transformation.

Gammatone filter bank (as described in Irino T., Patterson R. D.; "A compressive gammachirp auditory filter for both physiological and psychophysical date"; J. Acoust. Soc. Am., Vol. 109, pp. 2008-2022, 2001. The entire disclosure is incorporated by reference with subsequent formation of the signal envelopes of the individual sub-bands, optionally followed by a non-linear distortion.

Linear prediction (as described in Haykin S.; "Adaptive Filter Theory"; Prentice Hall Inc.; Englewood Cliffs; ISBN 0-13-048434-2, 2002. The entire disclosure is incorporated by reference with subsequent sampling of the magnitude of the spectral envelopes of the signal block, represented by the synthesis filter, optionally followed by a non-linear distortion and, subsequent to this, time-averaging.

Estimation of the real cepstrum (as described in Deller J. R., Hansen J. H. L., Proakis J. G.; "Discrete-Time Processing of Speech Signals"; IEEE Press; ISBN 0-7803-5386-2, 2000. The entire disclosure is incorporated by reference) followed by a retransformation of the cepstrum domain into the frequency domain and taking the antilogarithm, optionally followed by a non-linear distortion of the so obtained envelopes of the magnitude spectra and, subsequent to this, time-averaging.

Short-term DFT with maximum detection and interpolation: In this alternative, the maxima are detected in the magnitude spectrum of the short-term DFT and the envelope between neighboring maxima are calculated through linear or non-linear interpolation, optionally followed by a non-linear distortion of the obtained envelopes of the magnitude spectra and, subsequent to this, time-averaging.

For the optionally used time-averaging of the envelopes, an exponential smoothing of the optionally non-linearly distorted magnitude spectra may be applied as described in equations (1) with time constant $\alpha$ for the exponential smoothing. Alternatively, the time-averaging may be formed by a moving average filter. The non-linear distortion may, for example, be carried out through a power function with arbitrary exponents which, in addition, may be selected differently for the target and substitution channel, as depicted in equations (1) by the exponents $\gamma$ and $\delta$. (Alternatively, a logarithmic function may also be used.)

The non-linear distortion may weight time periods with high or low signal energy differently along the time-varying progression of each frequency component. The different weighting may affect the results of time-averaging within the respective frequency component. Accordingly, exponents r and 0 greater than 1 denote an expansion, e.g. peaks along the signal progression dominate the result of the time-averaging, whereas exponents less than 1 or about 1 may signify a compression, e.g. enhance periods with low signal energy. The optimal selection of the exponent values depends on the sound material to be expected.

$$|\overline{S_z(m)}| = \{\alpha|S_z|^\gamma + (1-\alpha)|\overline{S_z(m-1)}|^\gamma\}^{\frac{1}{\gamma}}, \tag{1a}$$

$$|\overline{S_s(m)}| = \{\alpha|S_s|^\delta + (1-\alpha)|\overline{S_s(m-1)}|^\delta\}^{\frac{1}{\delta}}, \tag{1b}$$

where $|S_Z|$, $|S_S|$: envelopes of the magnitude spectra of target and substitution channel, $|\overline{S_Z}|$, $|\overline{S_S}|$: time-averaged versions of $|\overline{S_Z}|$ and $|\overline{S_S}|$, $\alpha$: time constant of the exponential smoothing, $0<\alpha\leqq 1$, $\gamma$, $\delta$ exponents of the non-linear distortion of $|\overline{S_Z}|$ and $|\overline{S_S}|$, with a preferable value range of: $0.5\leqq\gamma$, $\delta\leqq 2$, m: block index.

As an example, equation (1) comprises a special case for the calculation of the spectral envelopes of target and substitution channel with exponential smoothing and arbitrary distortion exponents. In the following, the exponents are set to a predetermined value e.g., $\gamma=\delta-1$ to simplify formulations (e.g., a non-linear distortion is not explicitly indicated). However, the method may comprise any time-averaging methods and any non-linear distortions of the envelopes of the magnitude spectra. Any values for the exponents $\gamma$ and $\delta$. Beyond, the use of the logarithm of the exponential function is enclosed, too. To simplify notation, the block index m is omitted, though all magnitude values such as $|\overline{S_S}|$ and $|\overline{S_Z}|$ or H are considered to be time-variant and therefore a function of block index m.

In standard adaptive systems, concealment filters may be calculated by minimizing the mean square error between the target signal and its estimation. The difference signal is given by $e(n)=x_Z(n)-\hat{x}_Z(n)$. In contrast, some systems examine the error of the estimated magnitude spectra:

$$E(k)=|\overline{S_Z(k)}|-|\hat{S}_Z(k)|=|\overline{S_Z(k)}|-H(k)|\overline{S_S(k)}| \tag{2}$$

E(k) corresponds to the difference between the envelope of the magnitude spectra of the optionally non-linearly distorted optionally smoothed target signal and its estimation. The optimization problem may be observed separately for each frequency component k. A realization of the spectral filter H(k) may be determined by the two envelopes, with $$H(k)\frac{\overline{|S_z(k)|}}{\overline{|S_s(k)|}}. \tag{3}$$

Alternatively, a constraint of H(k) is suggested through the introduction of a regularization parameter. The underlying intention is to prevent the filter amplification from rising disproportionally if the signal power of $|\overline{S_S}|$ is too weak and hence background noise becomes audible or the system becomes perceptibly unstable. If, for example, the spectral peaks of one time-block of $|\overline{S_Z}|$ and $|\overline{S_S}|$ are not located in exactly the same frequency band, H(k) will rise excessively in these bands in which $|\overline{S_Z}|$ has a maximum and $|\overline{S_S}|$ has a minimum. To avoid this problem, a constraint for H(k) is established through the frequency dependent regularisation parameter $\beta(k)$, yielding $$H(k)\frac{|S_z(k)||S_s(k)|}{\overline{|S_s(k)|}^2+\beta(k)}. \tag{4}$$

Through positive real-valued $\beta(k)$, the filter amplification will not increase immoderately, even with a small value for $|\overline{S_S}|$, and hence, will prevent undesired signal peaks. The optimal values for $\beta(k)$ depends on the signal statistics, whereas a computation based on an estimation of the background noise power per frequency band is proposed. The background noise power $P_g(k)$ may be estimated incorporating the time-averaged minimum statistics. The regularisation parameter $\beta(k)$ is proportional to the rms value of the background noise power, according to:

$$\beta(k)=c\times[P_g(k)]^{\frac{1}{2}},$$

and c is typically between 1 and 5.

An alternative implementation of H is proposed specifically for quasi-stationary input signals. The envelopes of the magnitude spectra are first estimated without time-averaging and optionally non-linear distortion. Both modifications are considered during the determination of the filter coefficients, according to:

$$\overline{H(m,k)}=\left\{\alpha\left[\frac{|S_z(m,k)||S_s(m,k)|}{|S_s(m,k)|^2+\beta(k)}\right]^{\gamma}+(1-\alpha)\overline{H(m-1,k)}^{\gamma}\right\}^{\frac{1}{\gamma}} \tag{5}$$

In equation (5), both the block index m and the frequency index k are indicated, since the computation simultaneously depends on both indices in this case. The parameters $\alpha$ and $\gamma$ determine the behavior of the time-averaging or the non-linear distortion.

The possibilities for detecting a dropout may be frequent. For example, a status bit may be transmitted at a reserved position within the respective audio stream (e.g., between audio data frames), and continuously registered at the receiver side. It is also conceivable to perform an energy analysis of the individual frames and to identify a dropout if it falls below a certain threshold. A dropout may also be detected through synchronization between transmitter and receiver.

If a dropout is detected in the target signal (e.g. as represented in FIG. 2 by a status bit "dropout y/n"; the dotted line denotes the status bit that is transmitted contiguously with the audio signal), the replacement signal may be generated using the lastly estimated filter coefficients and the substitution channel(s), and is directly fed to the output of the concealment unit. During a dropout, the estimation of the filter coefficients is deactivated. The transition between target and replacement signal may be implemented by a switch, assuming any switching artifacts remain inaudible. A cross-fade between the signals may be advantageous, but this may require a buffering of the target signal that may induce delay. In delay-critical real-time systems that do not allow for any additional buffering, a cross-fade may not occur. In this case, an extrapolation of the target signal may occur, for example through a linear prediction. The cross-fade may occur between the extrapolated target signal and the replacement signal.

The replacement signal is generated through filtering of the substitution signal with the filter coefficients retransformed into the time domain. The inverse transformation of the filter coefficients $T^{-1}\{H\}$ may be carried out with the same method as the first transformation. Prior to the filtering, the filter impulse response is optionally time-limited by a windowing function w(n) (e.g. rectangular, Hanning).

$$h_W(n)=w(n)T^{-1}\{H(k)\}\text{ or }\overline{h_W(n)}=w(n)T^{-1}\{\overline{H(k)}\}. \tag{6}$$

The impulse response $h_W(n)$ or $h_W(n)$, respectively, may be calculated once at the beginning of the dropout, since the continuous estimation of the filter coefficients is deactivated during the dropout. For the sample-wise determination of the replacement signal $\hat{x}_Z$, an appropriate vector of the substitution signal $x_S$ is, $$\hat{x}_Z(n)=h_W^T x_S(n) \text{ or } \hat{x}_Z(n)=\bar{h}_W^T x_S(n). \tag{7}$$

In some applications, the filtering may occur in the frequency domain. Thus, the coefficients optionally windowed in the time domain are transformed back into the frequency domain, so that the replacement signal of a block is computed by:

$$\hat{x}_Z(n)=T^{-1}\{H_W^{\square}(k)X_S(k)\}. \tag{8}$$

Successive blocks may be combined using methods such as overlap and add or overlap and save. The replacement signal is continued beyond the end of the dropout to enable a cross-fade into the re-existing target signal. In some systems the concealment method, the time-alignment of target and replacement signal may be improved, too. Therefore, a time delay is estimated, parallel to the spectral filter coefficients, that takes two components into account. On the one hand, the delay of the replacement signal resulting from the filtering process may be compensated for, $$\tau_1 = \frac{L_{Filter}}{2}$$

On the other hand, a time delay $\tau_2$ between target and substitution channel originates due to the spatial arrangement of the respective microphones. This may be estimated, for example, through the generalized cross-correlation (GCC) that may require the computation of complex short-term spectra. In some systems, the short-term DFT employed for the estimation of the concealment filter may be exploited, too, obviating additional computational complexity. (For more information about the characteristics of the GCC, see especially Carter, G. C.: "Coherence and Time Delay Estimation"; Proc. IEEE, Vol. 75, No. 2, February 1987; and Omologo M., Svaizer P.: "Use of the Crosspower-Spectrum Phase in Acoustic Event Location"; IEEE Trans. on Speech and Audio Processing, Vol. 5, No. 3, May 1997, which are incorporated by reference.) The GCC may be calculated using inverse Fourier transform of the estimated generalized cross-power spectral density (GXPSD), which may be expressed as:

$$\Phi_{G,ZS}(k)=G(k)X_Z(k)X_S^*(k) \tag{9}$$

(again, in equations 9-12, the block index m is omitted.)

In equation (9), $X_Z(k)$ and $X_S(k)$ are the DFTs of a block of the target or substitution channel, respectively; * denotes complex conjugation. G(k) represents a pre-filter the aim of which is explained in the following.

The time delay $\tau_2$ is determined by indexing the maximum of the cross-correlation. The detection of the maximum may be improved by approximating its shape to a delta function. The pre-filter G(k) may directly affect the shape of the Gee and thus, enhances the estimation of $\tau_2$. A proper realisation denotes the phase transform filter (PHAT):

$$G_{PHAT}(k) = \frac{1}{|X_z(k)X_s^{\square}(k)|}. \tag{10}$$

This results in the GXPSD with PHAT filter:

$$\Phi_{G,ZS}(k) = \frac{X_z(k)X_s^o(k)}{|X_Z(k)X_s^o(k)|} = \frac{\Phi_{zs}(k)}{|X_z(k)X_s^o(k)|}, \tag{11}$$

where $\Phi_{ZS}$ cross-power spectral density of target and substitution signal.

Another method is offered by the complex coherence function whose pre-filter may be derived from the power density spectra, yielding:

$$\Gamma_{ZS}(k) = \frac{\Phi_{zs}(k)}{\sqrt{\Phi_{zz}(k)\Phi_{ss}(k)}} \tag{12}$$

$\Phi_{ZZ}$: auto-power spectral density of the target signal, $\Phi_{SS}$: auto-power spectral density of the substitution signal.

The transformation of the signals into the frequency domain may be implemented through a short-term DFT. The block length may be selected large enough to facilitate peaks in the GCC that are detectable for the expected time delays. Some methods avoid excessive block lengths that may lead to increased need for storage capacity. To adequately track variations of the time delay $\tau_2$, time-averaging of the GXPSD or of the complex coherence function is applied (e.g. by exponential smoothing).

$$\overline{\Phi_{G,ZS}(m,k)} = \mu\frac{\Phi_{zs}(m,k)}{|X_z(m,k)X_s^*(m,k)|} + (1-\mu)\overline{\Phi_{G,ZS}(m-1,k)} \tag{13}$$

$$\overline{\Gamma_{zs}(m,k)} = \nu\frac{\Phi_{zs}(m,k)}{\sqrt{\Phi_{zz}(m,k)\Phi_{ss}(m,k)}} + (1-\nu)\overline{\Gamma_{zs}(m-1,k)}. \tag{14}$$

In equations (13) and (14), m refers to the block index. The smoothing constants are designated with $\mu$ and $\nu$. These are adapted to the jump distance of the short-term DFT and the stationarity of $\tau_2$ in order to obtain the best possible estimation of the coherence function or the generalized cross-power spectral density, respectively.

After the retransformation into the time domain and the detection of the maximum of the GCC, the entire time delay element between target and replacement signal may be formulated by $$\Delta\tau=\tau_2-\tau_1. \tag{15}$$

The individual processing steps are summarized in FIG. 2 for one target and one substitution signal. The transition between target and replacement signal or vice-versa may occur through a multiple state circuit like a switch. A cross-fade of the signals may also occur.

Figure 3:
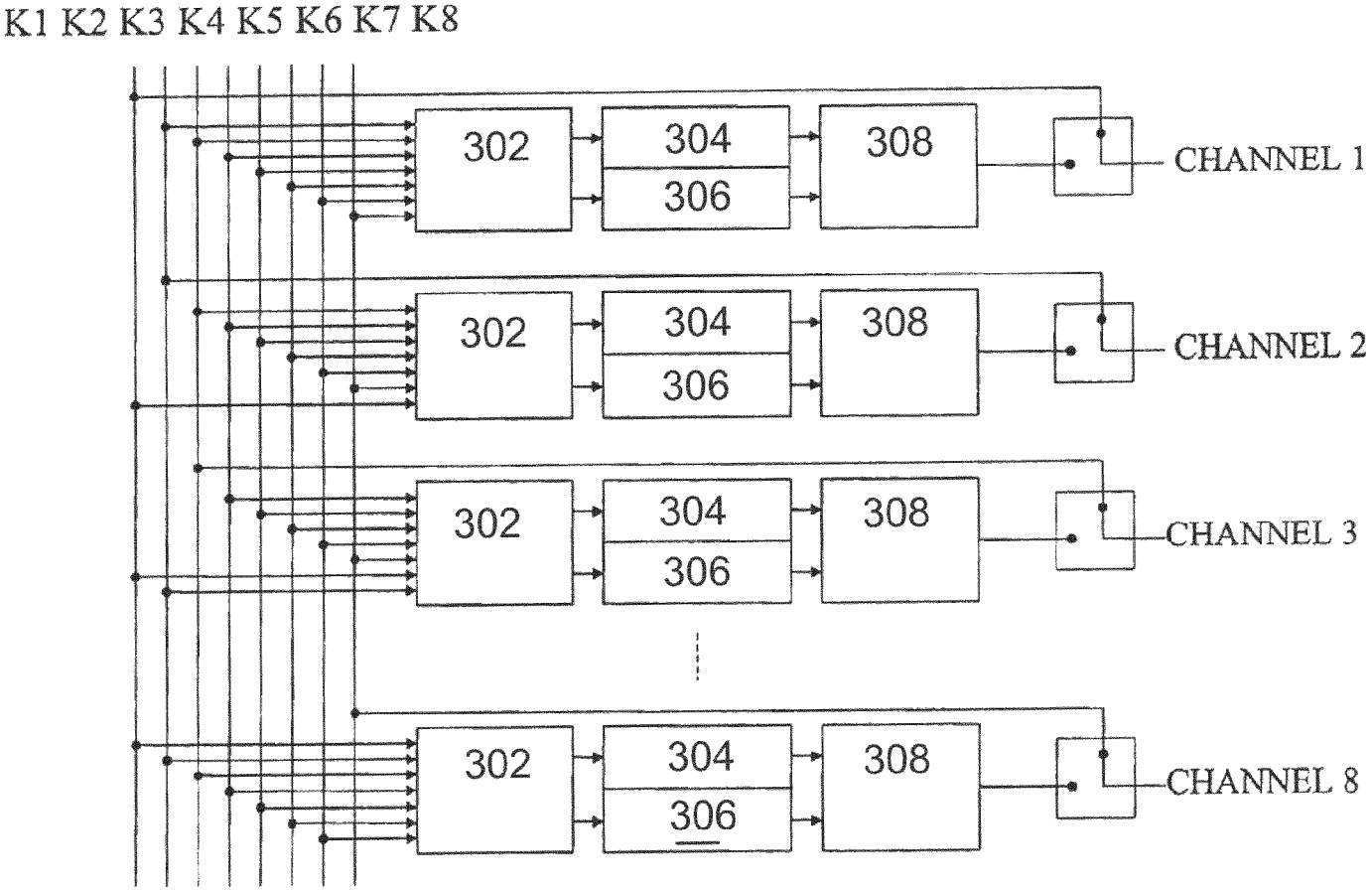
FIG. 3 is a block diagram of a multi-channel arrangement of an exemplary eight channels.

A multi-channel setup comprising more than two channels is shown FIG. 3. Depending on the channel affected by dropouts, and hence becomes the target channel, the substitution signal is generated with the remaining intact channels. The blocks of FIG. 3 may correspond to the following references:

302 Selection of the substitution channel(s)

304 Calculation of the filter coefficients

306 Application of a time delay

308 Generation of a replacement signal

In the uppermost row of FIG. 3, a replacement signal is generated for channel 1, which may be affected by dropouts. To generate a replacement, one, several, or all of the channels 2 to 7 may be processed. The second row may correspond to the reconstruction of channel 2, etc.

Figure 4:
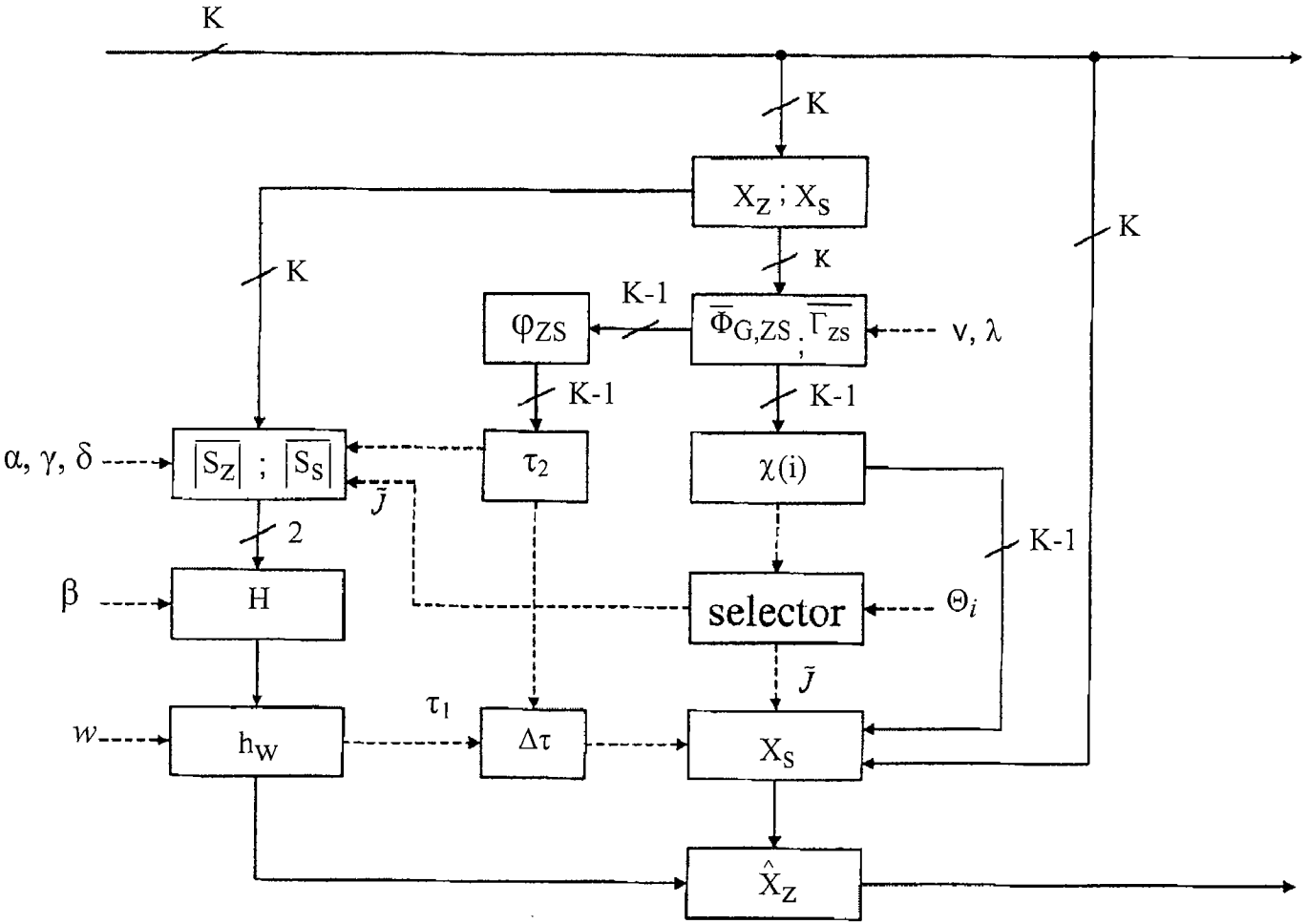
FIG. 4 is a process of generating a substitution signal.

FIG. 4 is a schematic of the basic algorithm in combination with the expansion stage (e.g., time delay estimation) that illustrates mutual dependencies of individual processing steps. To simplify the block diagram, parallel signals (DFT blocks) or (derived spectral) mappings are merged into one (solid) line, the number of which is indicated by K or K−1, respectively. The dotted connections denote the transfer or input of parameters. The first selection of the substitution channels is done in the block labeled "selector" according to the GXPSD. On the one hand, this may affect the computation of the envelopes of the magnitude spectra of the substitution signal and, on the other hand, it may be processed in a weighted superposition. The second selection criterion is offered by the time delay $\tau_2$. While the status bits of the channels are not shown, verification may occur in the relevant signal-processing blocks. In some systems, the determination of the target signal may be omitted.

Figure 5:
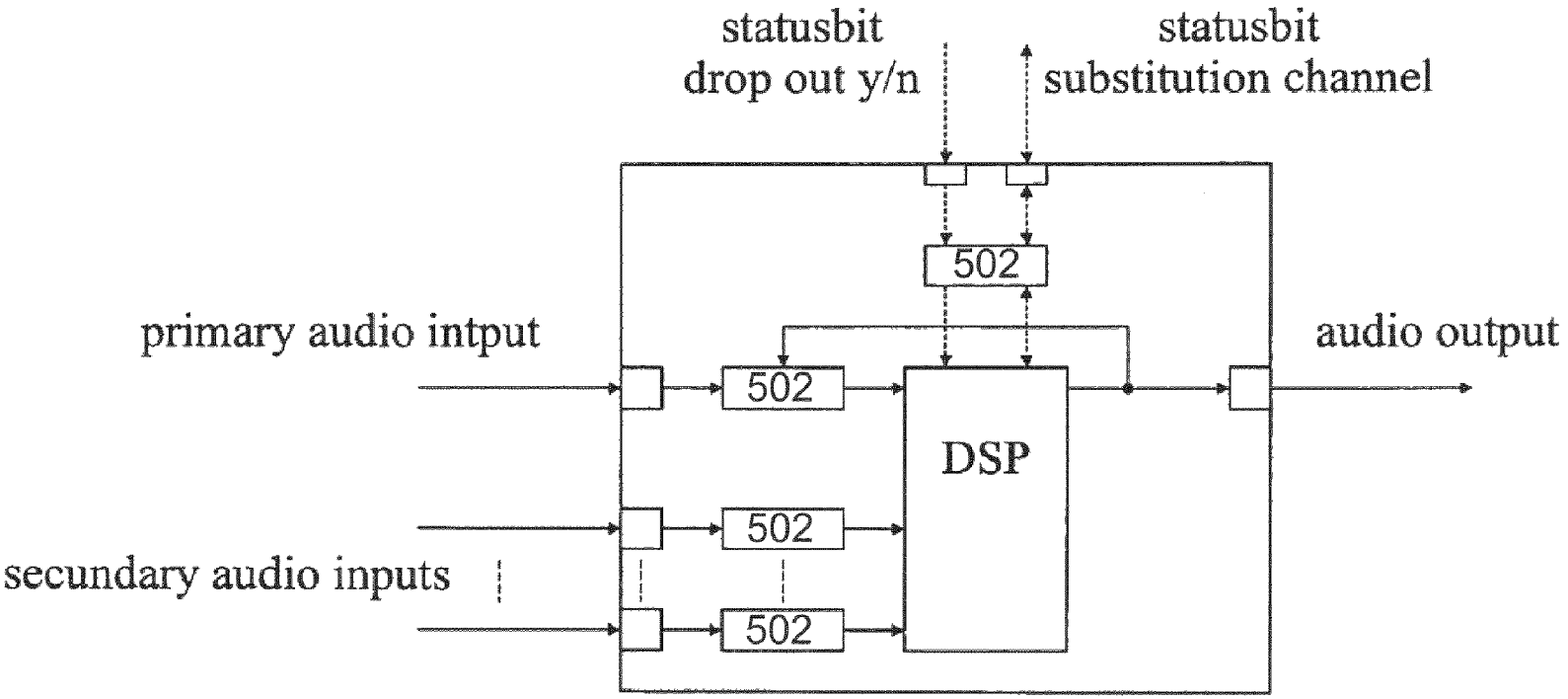
FIG. 5 is a device of dropout concealment that may be integrated into each channel of the multi-channel arrangement.

The dropout concealment method works as an independent module that executes a specialized task that interfaces a digital signal processing. In some systems, the software-specified algorithm may be implemented through a digital signal processor (DSP), preferably a customized DSP for audio applications. When integrated into a computer-readable media component, it may include a firmware component that is implemented in a permanent memory module. The firmware may be programmed and tested like software, and may be distributed with a processor or controller. Firmware may be implemented to coordinate operations of the processor or controller and contains programming constructs used to perform such operations. Such systems may further include an input and output interface that may communicate with a wireless communication bus through any hardwired or wireless communication protocol. For each channel of a multi-channel arrangement, an appropriate device, such as exemplarily system shown in FIG. 5, may be integrated directly into, interfaced, or may be a unitary part of a system that receives and decodes the transmitted digital audio data.

The dropout concealment apparatus may include a primary audio input that adopts the digital signal frames from the receiver unit and temporarily stores them in a storage unit 502. In some systems, a controller or background processor may perform a specialized task such as providing access to the memory, freeing the digital signal processor for other tasks. The apparatus may be equipped with at least one secondary audio input, one or more secondary optional audio inputs, at which the digital data of the substitution channel(s) are available and likewise stored temporarily in one, optionally several, storage unit(s) 502.

In addition, the device features an interface for the transmission of control data such as the status bit of the signal frames (dropout y/n) or an information bit for the selection of the substitution channel(s), the latter requiring (a) a bidirectional data line and (b) a temporary storage unit 502.

To forward the original or concealed data frames of the primary channel, the apparatus may interface or include an audio output. A separate storage unit for the data blocks to be output may not be necessary, since the data may be stored as needed in the storage unit of the input signal.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A method conceals dropouts in one or more audio channels of a multi-channel arrangement comprising at least two channels, where in the event of a dropout in an audio channel a replacement signal is generated through at least one error-free channel, comprising:

mapping a plurality of transmitted signals into a frequency domain during an error-free signal transmission of the at least two channels;

determining a magnitude spectra; and deriving spectral filter coefficients that relate the magnitude spectrum of the audio channel to the magnitude spectrum of at least one other channel;

where in the event of a dropout of the audio channel the replacement signal is generated by an application of filter coefficients to a substitution signal which comprises the at least one error-free channel; and where filter coefficients were generated prior to the signal dropping out.

2. The method of claim 1 where the magnitude spectra are distorted non-linearly prior to the derivation of the filter coefficients.

3. The method of claims 1 where the magnitude spectra are time-averaged prior to the derivation of the filter coefficients.

4. The method of claim 1 where the filter coefficients are derived by minimizing the difference between a non-linearly distorted and/or time-averaged magnitude spectrum of the audio channel, and a non-linearly distorted and/or time-averaged magnitude spectrum of the at least one error-free channel filtered through the filter coefficients.

5. The method of claim 1 where the derivation of the filter coefficients comprises a quotient of the magnitude spectra comprising:

$$\frac{|S_z(k)|}{|S_s(k)|}.$$

6. The method of claim 1 where a regularisation of the filter coefficients occurs through a frequency-dependent parameter.

7. The method of claim 6 where the regularisation occurs through a quotient comprising:

$$\frac{|S_z(k)||S_s(k)|}{|S_s(k)|^2 + \beta(k)}.$$

8. The method of claim 7 where an estimation of the frequency dependent parameter comprises a root mean square value of a background noise level, where the frequency dependent parameter comprises a constant multiplied by a square root of a portion of the background noise level and the constant comprises a value selected from a range from about 1 to about 5.

9. The method of claim 1 further comprising deriving envelopes of the magnitude spectra through a short-term discrete Fourier transform.

10. The method of claim 1 where envelopes of the magnitude spectra are derived by incorporating the magnitude spectra of a wavelet transformation, or a per channel root mean square of a gammatone filter bank, or a linear prediction with subsequent sampling of the magnitude of the spectral envelopes of a signal frame represented by a synthesis filter, or a real cepstral analysis with a subsequent retransformation of a cepstral domain into the frequency domain, or a short-term DFT with a maximum detection and an interpolation of the magnitude spectra, respectively.

11. The method of claim 3 where the time-averaging of a magnitude spectrum comprises exponential smoothing through a smoothing constant.

12. The method of claim 3 where the time-averaging of a magnitude spectrum is rendered through a moving average filter.

13. The method of claim 2 where the non-linear distortion and a time-averaging of the magnitude spectrum substantially adheres to a formulation comprising:

$$\overline{|S_2(m)|} = \{\alpha|S_z|^\gamma + (1-\alpha)\overline{|S_z(m-1)|}^\gamma\}^{\frac{1}{\gamma}} \text{ or } \overline{|S_s(m)|} = \left\{\alpha|S_s|^\delta + (1-\alpha)\overline{|S_s(m-1)|}^\delta\right\}^{\frac{1}{\delta}}$$

where $\alpha$ comprises a smoothing constant in the range of $0<\alpha<1$, m comprises a block index and a $\gamma$, a $\delta$ comprises distortion exponents for the magnitude spectra.

14. The method of claim 2 where the non-linear distortion is rendered through a logarithmic and exponential function, where $$\overline{|S_Z(m)|} = e^{\{\alpha ln\{|S_Z|\}+(1-\alpha)ln\{\overline{|S_Z(m-1)|}\}\}}$$

and $$\overline{|S_S(m)|} = e^{\{\alpha ln\{|S_S|\}+(1-\alpha)ln\{\overline{|S_S(m-1)|}\}\}}.$$

15. The method of claim 1 where the derivation of the filter coefficients comprises a time-averaging of the coefficients that comprises $$\left\{\alpha\left[\frac{|S_z(m,k)||S_s(m,k)|}{|S_s(m,k)|^2+\beta(k)}\right]^\gamma + (1-\alpha)\overline{H(m,k)}^\gamma\right\}^{\frac{1}{\gamma}}.$$

16. The method of claim 1 where the filter coefficients are transformed into a time domain, and a filter impulse response is bounded in time domain though a windowing function.

17. The method of claims 1 where the replacement signal is generated through the filtering of an error-free substitution channel in a time domain.

18. The method of claim 1 where a bounded filter impulse response is converted to the frequency domain, and a filtering of the substitution signal occurs in the frequency domain.

19. The method of claim 1 where transition between the target signal and the replacement signal occurs through a cross-fade transition.

20. The method of claim 19 where a linear prediction filter is configured to execute an extrapolation that implements the cross-fade transition without buffering data.

21. The method of claim 1 further comprising measuring a time delay between the plurality of transmitted signals and applying the time delay to the replacement signal.

22. The method of claim 21 where the time delay is determined from a maximum of a generalized cross-correlation of the plurality of transmitted signals.

23. The method of claim 22 where the time delay is reduced by a second time delay that occurs due to a filtering of the substitution signal with the time domain filter coefficients, yielding a third time delay that is applied to the replacement signal.

24. The method of claim 22 where the generalized cross-correlation is determined from a generalized cross-power spectral density expressed as:

$$\Phi_{G,ZS}(k)=G(k)X_Z(k)X_S^*(k)$$

through inverse transformation into the time domain; where (G(k)) comprises a pre-filter and ($X_Z$, $X_S$) comprises the complex spectra of the plurality of transmitted signals.

25. The method of claim 24 where (G(k)) further comprises the phase transform of filter comprising:

$$G_{PHAT}(k) = \frac{1}{|X_z(k)X_s^*(k)|}.$$

26. The method of claim 22 where the generalized cross-correlation is determined by inverse transformation of the coherence function comprising $$\Gamma_{zs}(k) = \frac{\Phi_{zs}(k)}{\sqrt{\Phi_{zz}(k)\Phi_{ss}(k)}}$$

into the time domain, where $$\Phi_{ZS}(k)=X_Z(k)X_S^*(k) \text{ and } \Phi_{ZZ}(k) \text{ and } \Phi_{SS}(k)$$

comprise auto-power spectral densities of the at least two channels.

27. The method of claim 22 where frequency spectra of the plurality of transmitted signals are generated by a short-term discrete Fourier transform.

28. The method of claim 21 where prior to a transformation into the time domain, the generalized cross-power spectral density or a coherence function is time-averaged through an exponential smoothing.

29. The method of claim 1 where a signal $X_j(n)$ is selected as a substitution signal, whose frequency-averaged version of the coherence function comprising $$\chi(i) = \frac{1}{N}\sum_{k=0}^{N-1}|\overline{\Gamma_{zs,j}(k)}|$$

is a maximum, according to $$x_s(n) = x_J(n) \text{ with } J = \arg\max_j \chi(j).$$

30. The method of claim 1 where the substitution signal is comprised of a plurality of weighted signals.

31. The method of claim 30 where a superposition of a plurality of channels that form one substitution channel is implemented, according to $$x_s(n) = \frac{\sum_{j\in\tilde{J}}\{\chi(j)\cdot x_j(n-\Delta\tau_j)\}}{\sum_{j\in\tilde{J}}\chi(j)},$$

where $\tilde{J}$ comprises a set of the indices of potential channels and the superposition processes each time delay.

32. The method of claim 31 where the size of $\tilde{J}$ is delimited by a user.

33. The method of claim 31 where the size of $\tilde{J}$ is restricted to channels whose frequency-averaged values of the coherence function with a target channel exceed a threshold value $\Theta$, according to:

$$\tilde{J}=\{j|(1\leqq j\leqq K-1)\wedge[\chi(j)>\Theta]\}.$$

34. The method of claim 33 where the size of $\tilde{J}$ is restricted to a maximum number of M channels, comprising:

$$\tilde{J}=\{j_i|(1\leqq j_i\leqq K-1)\wedge(1\leqq i\leqq M)\wedge[\chi(j_i)>\chi(l),\ \forall l\in\{1,\ldots,K-1\}\backslash\{j_1,\ldots,j_M\}]\}.$$

35. The method of claim 31 where the criteria threshold value $\Theta$ and maximum number M are jointly processed comprising:

$$\tilde{J}=\{j_i|(1\leqq j_i\leqq K-1)\wedge(1\leqq i\leqq M)\wedge(\chi(j_i)>\Theta)\wedge[\chi(j_i)<\chi(l),\forall l\in\{1,\ldots,K-1\}\backslash\{j_1,\ldots,j_M\}]\}.$$

36. The method of claim 1 where different substitution signals are processed for different frequency bands of the replacement signal.

37. The of claim 36 where for each frequency band k, a band-pass-filtered version of a signal is selected as a substitution signal whose time-averaged coherence function comprises $$|\overline{\Gamma_{ZS,j}(k)}|$$

with the signal to be replaced has a maximum value in the respective frequency band k prior to the dropout, comprising:

$$x_{S,k}(n)=x_{J,k}(n),\text{ where }J=\arg\max_j|\overline{\Gamma_{ZS,j}(k)}|.$$

* * * * *